US011823638B2

(12) United States Patent
Yoneyama

(10) Patent No.: US 11,823,638 B2
(45) Date of Patent: Nov. 21, 2023

(54) DISPLAY CIRCUIT DEVICE, DISPLAY DEVICE, AND ELECTRONIC APPARATUS

(71) Applicant: SEIKO EPSON CORPORATION, Tokyo (JP)

(72) Inventor: Yusuke Yoneyama, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/747,522

(22) Filed: May 18, 2022

(65) Prior Publication Data

US 2022/0375422 A1 Nov. 24, 2022

(30) Foreign Application Priority Data

May 20, 2021 (JP) ..... 2021-085141

(51) Int. Cl.
*G09G 3/36* (2006.01)

(52) U.S. Cl.
CPC ... *G09G 3/3648* (2013.01); *G09G 2310/0291* (2013.01); *G09G 2330/12* (2013.01)

(58) Field of Classification Search
CPC ..... G09G 3/3648; G09G 2310/0291; G09G 2330/12
See application file for complete search history.

(56) References Cited

U.S. PATENT DOCUMENTS 9,514,713 B2 * 12/2016 Lee ..... G09G 5/18
2012/0036418 A1 * 2/2012 Morino ..... B60K 35/00 714/E11.032
2019/0333460 A1 * 10/2019 Mitsuzawa ..... G09G 3/3648
2020/0342796 A1 * 10/2020 Kobayashi ..... G09G 3/2096

FOREIGN PATENT DOCUMENTS

JP 2012-035677 2/2012

* cited by examiner

*Primary Examiner* — Kenneth B Lee, Jr.
(74) *Attorney, Agent, or Firm* — Rankin, Hill & Clark LLP

(57) ABSTRACT

A display circuit device includes a CPU, a display control circuit, and a drive signal generation circuit. The drive signal generation circuit includes a generation circuit that generates a first CRC value that is a CRC value of command data received from the CPU, and a transmission circuit that transmits the first CRC value to the CPU. The CPU includes an expected value generation circuit that generates a second CRC that is a CRC value of command data before being input to the drive signal generation circuit, a reception circuit that receives the first CRC value, a comparison circuit that compares the first CRC value with the second CRC value, and a control circuit that executes control based on a comparison result obtained by the comparison circuit.

12 Claims, 12 Drawing Sheets

DISPLAY CIRCUIT DEVICE, DISPLAY DEVICE, AND ELECTRONIC APPARATUS

The present application is based on, and claims priority from JP Application Serial Number 2021-085141, filed May 20, 2021, the disclosure of which is hereby incorporated by reference herein in its entirety.

BACKGROUND

1. Technical Field

The present disclosure relates to a display circuit device, a display device, and an electronic apparatus.

2. Related Art

As shown in JP-A-2012-35677, a technique for detecting, when image data is transmitted from an upstream circuit to a downstream circuit, whether an error has occurred in image data received by the downstream circuit with respect to image data transmitted by the upstream circuit using cyclic redundancy check (CRC) has been prevalent.

However, in the technique described in JP-A-2012-35677, the error in the image data can be detected, but an error in command data transmitted from the upstream circuit to the downstream circuit cannot be detected. Therefore, even though an error occurs in the command data, the error may be overlooked, which may lead to a malfunction of the downstream circuit.

SUMMARY

A display circuit device includes: a processing device; a display control circuit; and a drive circuit to which command data is received from the processing device and image data is received from the display control circuit and that is configured to drive a display panel based on the image data and the command data. The drive circuit includes: a first generation circuit configured to generate a first CRC value that is a CRC value of the command data received from the processing device; and a first transmission circuit configured to transmit the first CRC value to the processing device. The processing device includes: a first expected value generation circuit configured to generate a first CRC expected value that is a CRC value of the command data before being input to the drive circuit; a first reception circuit configured to receive the first CRC value transmitted by the first transmission circuit; a first comparison circuit configured to compare the first CRC expected value generated by the first expected value generation circuit with the first CRC value received by the first reception circuit; and a control circuit configured to execute control based on a comparison result between the first CRC expected value and the first CRC value, the comparison result being obtained by the first comparison circuit.

A display circuit device includes: a processing device; a display control circuit; and a drive circuit to which command data is received from the processing device and image data is received from the display control circuit, and that is configured to drive the display panel based on the image data and the command data. The drive circuit includes: a first generation circuit configured to generate a first CRC value that is a CRC value of the command data received from the processing device; and a first transmission circuit configured to transmit the first CRC value to the display control circuit. The display control circuit includes: a first expected value generation circuit configured to generate a first CRC expected value that is a CRC value of the command data before being input to the drive circuit; a first reception circuit configured to receive the first CRC value transmitted by the first transmission circuit; and a first comparison circuit configured to compare the first CRC expected value generated by the first expected value generation circuit with the first CRC value received by the first reception circuit.

The processing device includes the control circuit configured to execute control based on a comparison result between the first CRC expected value and the first CRC value, the comparison result being obtained by the first comparison circuit.

A display device includes the display circuit device described above and the display panel.

An electronic apparatus includes the display device described above.

DESCRIPTION OF EXEMPLARY EMBODIMENTS

Figure 1:
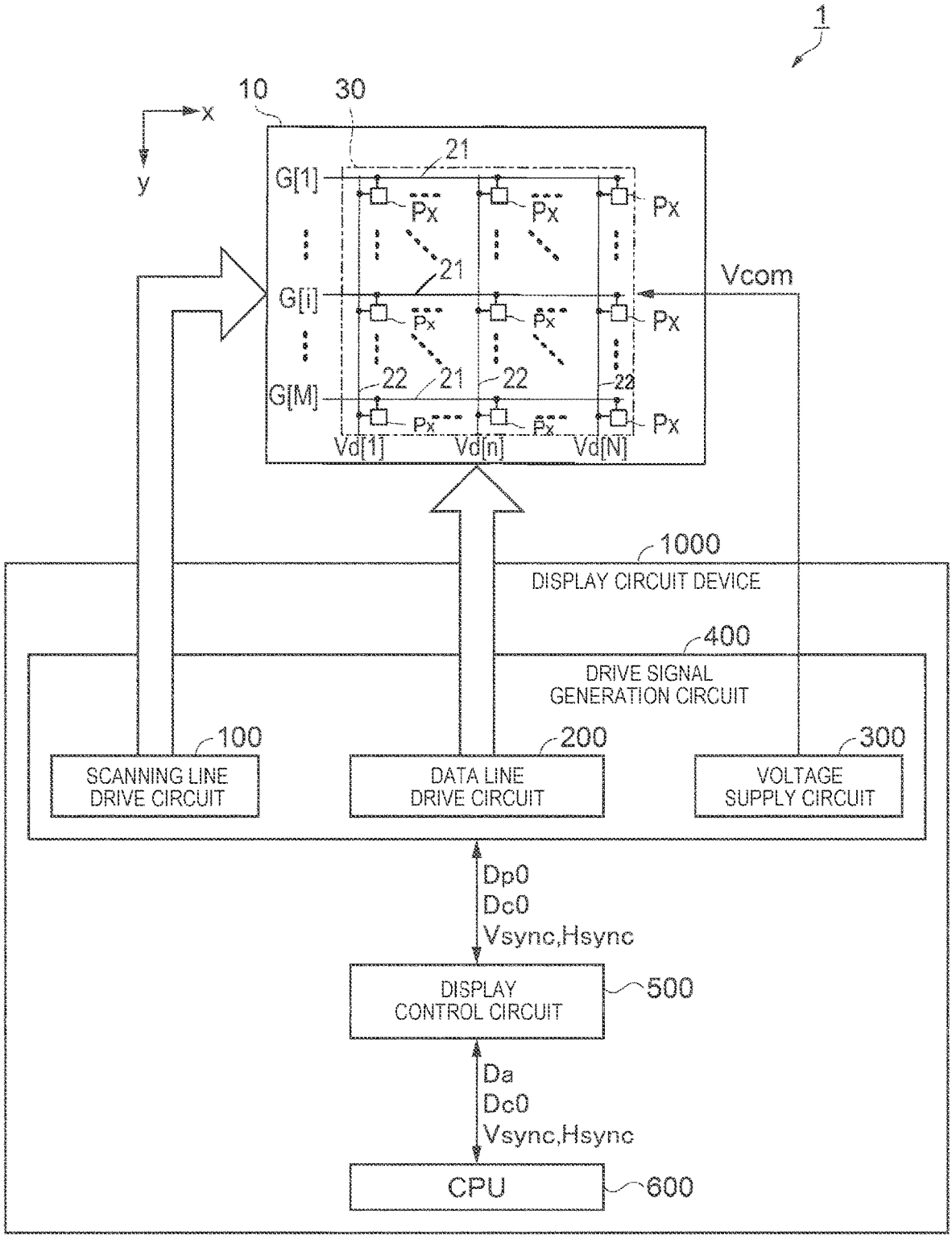
FIG. 1 is a block diagram showing a configuration of an electro-optical device.

Hereinafter, embodiments will be described with reference to the drawings. However, in the drawings, a dimension and a scale of each part are appropriately different from an actual one. The embodiments described below are provided with various technically preferable limitations, but the embodiments are not limited to these embodiments.

A. First Embodiment

FIG. 1 is a block diagram showing a configuration of an electro-optical device 1 as a display device. The electro-optical device 1 includes an electro-optical panel 10 and a display circuit device 1000 that displays an image on the electro-optical panel 10. The electro-optical panel is a display panel using an electro-optical material whose optical characteristics change with electric energy. Examples of the electro-optical material include a liquid crystal, organic electroluminescence, and a charged substance used in an electrophoretic element. In the present embodiment, the electro-optical panel 10 using the liquid crystal as the electro-optical material will be described.

In the electro-optical panel 10, an axis along a scanning line 21 is defined as an x axis, and an axis orthogonal to the x axis is defined as a y axis. The electro-optical panel 10 is formed with M scanning lines 21 of first to M-th rows extending along the x axis and N data lines 22 of first to N-th columns extending along the y axis. Here, M and N are natural numbers. In the electro-optical panel 10, pixel circuits Px constituting pixels are arranged in a matrix of vertical M rows×horizontal N columns corresponding to intersections of the scanning lines 21 and the data lines 22.

As shown in FIG. 1, the display circuit device 1000 includes a CPU 600 as a processing device, a display control circuit 500, and a drive signal generation circuit 400 as a drive circuit. In the display circuit device 1000, the CPU 600 supplies input image data Da, a control signal, and command data Dc0 to the display control circuit 500. Here, the input image data Da includes data that defines a gradation to be displayed in each pixel circuit Px. For example, the input image data Da may be digital data in which the gradation to be displayed in each pixel is defined by 8 bits. The control signal includes a synchronization signal such as a vertical synchronization signal Vsync and a horizontal synchronization signal Hsync. The command data Dc0 is data for setting an operation of the drive signal generation circuit 400, and is output to the drive signal generation circuit 400 via the display control circuit 500. The drive signal generation circuit 400 executes, for example, on and off of display, adjustment of color, setting of a drive power supply, setting of a display timing, and the like according to the supplied command data Dc0. The command data Dc0 may be directly supplied from the CPU 600 to the drive signal generation circuit 400 without going through the display control circuit 500. In the present embodiment, the CPU 600 has a function of detecting errors in various types of data supplied to the drive signal generation circuit 400 by cyclic redundancy check (CRC). Details of this error detection function will be described later.

The vertical synchronization signal Vsync is a synchronization signal instructing start of a vertical scan period, and is a vertical start pulse signal having one pulse at the beginning of the vertical scanning period. The horizontal synchronization signal Hsync is a synchronization signal instructing start of a horizontal scan period, and is a horizontal start pulse signal having one pulse at the beginning of the horizontal scanning period.

The display control circuit 500 generates various control signals based on a synchronization signal supplied from the CPU 600, and controls the drive signal generation circuit 400. The display control circuit 500 generates image data Dp0 indicating an image to be displayed on the electro-optical panel 10 based on the input image data Da supplied from the CPU 600, and outputs the image data Dp0 to the drive signal generation circuit 400.

The drive signal generation circuit 400 is a circuit that executes signal generation processing of generating a drive signal for driving the electro-optical panel 10. The drive signal generation circuit 400 generates a drive signal based on the image data Dp0 received from the display control circuit 500 and the command data Dc0 received from the CPU 600, and supplies the generated drive signal to the electro-optical panel 10 to drive the electro-optical panel 10 to display an image. The drive signal generation circuit 400 includes a scanning line drive circuit 100, a data line drive circuit 200, and a voltage supply circuit 300.

The voltage supply circuit 300 is a circuit that supplies, as drive signals, various voltages such as a common voltage Vcom for a common electrode 30 of the electro-optical panel 10, a power supply voltage for the scanning line drive circuit 100, and a power supply voltage for the data line drive circuit 200.

The scanning line drive circuit 100 is a circuit that drives the M scanning lines 21 in the electro-optical panel 10. The display control circuit 500 supplies the vertical synchronization signal Vsync and the horizontal synchronization signal Hsync received from the CPU 600 to the scanning line drive circuit 100. The scanning line drive circuit 100 sequentially selects M scanning lines 21 in synchronization with the horizontal synchronization signal Hsync each time the vertical synchronization signal Vsync is given, and sets a scanning signal G [i] for the selected scanning lines 21 to be at an active level. Here, i is a natural number from 1 to M.

The data line drive circuit 200 is a circuit that drives N data lines 22 in the electro-optical panel 10. The display control circuit 500 supplies the vertical synchronization signal Vsync and the horizontal synchronization signal Hsync that are received from the CPU 600 to the data line drive circuit 200. The data line drive circuit 200 receives the image data Dp0 for one frame from the display control circuit 500 each time the vertical synchronization signal Vsync is given. In a process of receiving the image data Dp0 for one frame, the data line drive circuit 200 repeats an operation of D/A converting the image data for one line out of the image data for M lines constituting the image data Dp0 for one frame each time the horizontal synchronization signal Hsync is given, and outputting the image data for one line to the N data lines 22 as the analog data signal Vd [n]. Here, n is a natural number from 1 to N.

Figure 2:
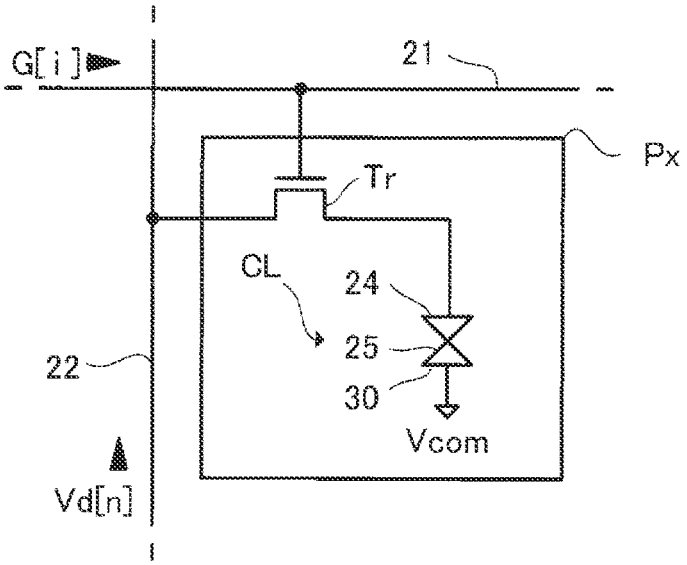
FIG. 2 is a circuit diagram of a pixel circuit.

FIG. 2 is a circuit diagram of each pixel circuit Px provided in the electro-optical panel 10. As shown in FIG. 2, each pixel circuit Px includes a liquid crystal element CL and a write-in transistor Tr. The liquid crystal element CL includes a common electrode 30, a pixel electrode 24, and a liquid crystal 25 provided between the common electrode 30 and the pixel electrode 24. Here, the common electrode 30 faces the pixel electrodes 24 of all the pixels on the electro-optical panel 10. The common voltage Vcom supplied from the voltage supply circuit 300 is applied to the common electrode 30. The liquid crystal 25 of the liquid crystal element CL changes a transmittance thereof according to a voltage applied to the liquid crystal element CL, more precisely, a voltage applied between the common electrode 30 and the pixel electrode 24.

In the present embodiment, the write-in transistor Tr is an N-channel transistor in which a gate is coupled to the scanning line 21, and is provided between the liquid crystal element CL and the data line 22 to control an electrical coupling between the liquid crystal element CL and the data line 22. That is, the write-in transistor Tr controls whether the liquid crystal element CL and the data line 22 are conductive or non-conductive. When the scanning signal G [i] that is a driving signal is set to be at the active level, the write-in transistor Tr in each pixel circuit Px of the i-th row simultaneously transitions to an on state.

At a timing when the scanning line 21 corresponding to the pixel circuit Px is selected and the write-in transistor Tr of the pixel circuit Px is controlled to be in the on state, the data signal Vd [n] that is a drive signal is supplied from the data line 22 to the pixel circuit Px. As a result, since the liquid crystal 25 of the pixel circuit Px is set to have a transmittance corresponding to the data signal Vd [n], a pixel corresponding to the pixel circuit Px displays the gradation corresponding to the data signal Vd [n].

Figure 3:
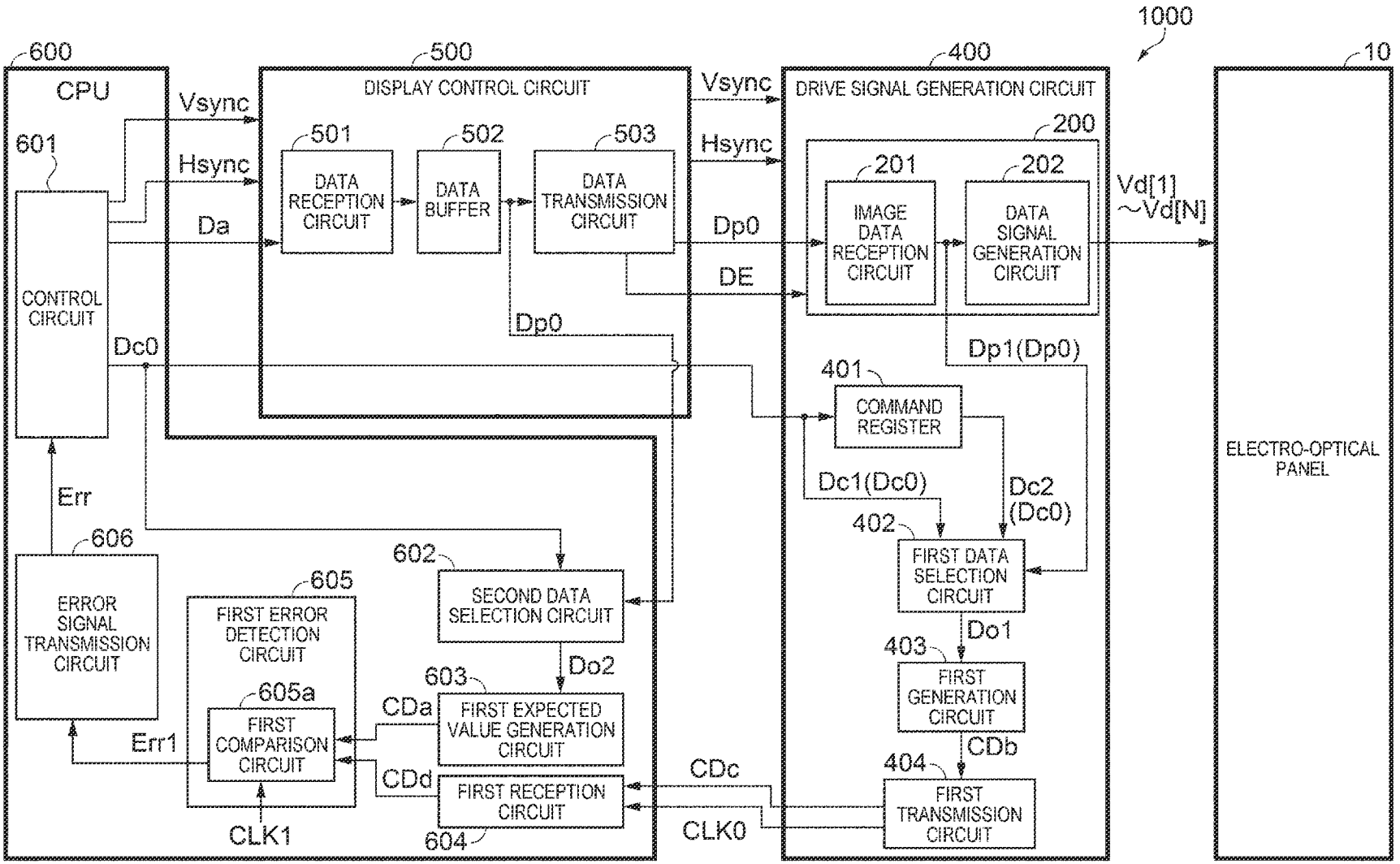
FIG. 3 is a block diagram showing a configuration of a display circuit device according to a first embodiment.

FIG. 3 is a block diagram showing a configuration of the display circuit device 1000 according to the first embodiment. In FIG. 3, the scanning line drive circuit 100 and the voltage supply circuit 300 that are provided in the drive signal generation circuit 400 are not shown.

The CPU 600 includes a control circuit 601. The control circuit 601 transmits the input image data Da, the vertical synchronization signal Vsync, and the horizontal synchronization signal Hsync to the display control circuit 500, and transmits the command data Dc0 to the drive signal generation circuit 400 via the display control circuit 500. Configurations other than the control circuit 601 will be described later.

The display control circuit 500 includes a data reception circuit 501, a data buffer 502, and a data transmission circuit 503. The data reception circuit 501 receives the input image data Da from the CPU 600 and stores the input image data Da in the data buffer 502. The data transmission circuit 503 extracts the image data for one frame from the data buffer 502 each time the vertical synchronization signal Vsync is generated, and transmits the image data as the image data Dp0 indicating the display target of the electro-optical panel 10 to the drive signal generation circuit 400. The display control circuit 500 transmits the vertical synchronization signal Vsync and the horizontal synchronization signal Hsync to the drive signal generation circuit 400.

The drive signal generation circuit 400 includes a command register 401, a first data selection circuit 402, a first generation circuit 403, and a first transmission circuit 404 in addition to the scanning line drive circuit 100, the data line drive circuit 200, and the voltage supply circuit 300 that are described above. The data line drive circuit 200 includes an image data reception circuit 201 and a data signal generation circuit 202. The image data reception circuit 201 receives the image data Dp0 for one frame from the display control circuit 500 each time the vertical synchronization signal Vsync is generated. When the electro-optical panel 10 includes M rows and N columns of pixels, the image data Dp0 for one frame is image data for M lines indicating a gradation to be displayed on each pixel corresponding to respective scanning lines 21 of the M scanning lines 21. The image data for one line is the image data for N pixels indicating the gradation to be displayed on N pixels corresponding to one scanning line 21.

The data signal generation circuit 202 repeats the operation of generating the data signal Vd [n] to be output to the N data lines 22 in synchronization with the horizontal synchronization signal Hsync. More specifically, each time the horizontal synchronization signal Hsync is generated, the data signal generation circuit 202 D/A converts the latest image data for one line, that is, N pixels in the image data Dp0 received by the image data reception circuit 201, and generates the data signal Vd [n] to be output to the N data lines 22.

The command register 401 stores the command data Dc0 received from the control circuit 601. The drive signal generation circuit 400 executes various types of setting based on the command data Dc0 stored in the command register 401.

The image data Dp0 for one frame received by the image data reception circuit 201, the command data Dc0 before being output from the control circuit 601 and stored in the command register 401, and the command data Dc0 read from the command register 401 after being stored in the command register 401 are input to the first data selection circuit 402.

The image data Dp0 input to the first data selection circuit 402 is originally the same data as the image data Dp0 read from the data buffer 502, but may vary due to an error. Therefore, the image data Dp0 input to the first data selection circuit 402 is hereinafter referred to as image data Dp1 in order to distinguish between the image data Dp0 input to the first data selection circuit 402 and the image data Dp0 read from the data buffer 502. Similarly, the command data Dc0 input to the first data selection circuit 402 is originally the same data as the command data Dc0 output from the control circuit 601, but may vary due to an error. Therefore, in order to distinguish between the command data Dc0 input to the first data selection circuit 402 and the command data Dc0 output from the control circuit 601, the command data Dc0 before being stored in the command register 401 is referred to as command data Dc1, and the command data Dc0 read from the command register 401 is referred to as command data Dc2. The first data selection circuit 402 selects one of the image data Dp1, the command data Dc1, and the command data Dc2 according to elapsed time from the generation of the vertical synchronization signal Vsync, and outputs the selected data as target data Do1 to the first generation circuit 403. The command data Dc1 corresponds to first command data, and the command data Dc2 corresponds to second command data. The first data selection circuit 402 corresponds to a first selection circuit that selects and outputs one of the command data Dc1 and the command data Dc2, and corresponds to a second selection circuit that selects and outputs one of the command data Dc1, Dc2, and the image data Dp1.

The first generation circuit 403 generates a code CDb, which is a CRC value for error detection, based on the target data Do1 output from the first data selection circuit 402. That is, the first generation circuit 403 generates a CRC value of the command data Dc1 as the code CDb when the first data selection circuit 402 selects the command data Dc1, generates a CRC value of the command data Dc2 as the code CDb when the first data selection circuit 402 selects the command data Dc2, and generates a CRC value of the image data Dp1 as the code CDb when the first data selection circuit 402 selects the image data Dp1. When the first generation circuit 403 generates the CRC values of the command data Dc1 and Dc2, the generated code CDb corresponds to the first CRC value, and when the first generation circuit 403 generates the CRC value of the image data Dp1, the generated code CDb corresponds to the second CRC value.

Each time the first generation circuit 403 generates the code CDb, the first transmission circuit 404 converts the code CDb to a code CDc which is a serial bit string, and transmits each bit constituting the code CDc to the CPU 600 in synchronization with a clock CLK0. The code CDc and the clock CLK0 may be transmitted to the CPU 600 via the display control circuit 500.

Next, the description returns to a configuration of the CPU 600. The CPU 600 includes a second data selection circuit 602, a first expected value generation circuit 603, a first reception circuit 604, a first error detection circuit 605, and an error signal transmission circuit 606 in addition to the control circuit 601. The image data Dp0 for one frame to be transmitted from the data buffer 502 of the display control circuit 500 is input to the second data selection circuit 602, and the command data Dc0 to be output toward the drive signal generation circuit 400 is input to the second data selection circuit 602. The second data selection circuit 602 selects one of the image data Dp0 and the command data Dc0 according to the elapsed time from the generation of the vertical synchronization signal Vsync, and outputs the selected data as the target data Do2 to the first expected value generation circuit 603. The second data selection circuit 602 corresponds to a third selection circuit that selects and outputs one of the command data Dc0 and the image data Dp0.

The first expected value generation circuit 603 generates a code CDa, which is a CRC value, based on the target data Do2 received from the second data selection circuit 602. That is, the first expected value generation circuit 603 generates a CRC value of the command data Dc0 as the code CDa when the second data selection circuit 602 selects the command data Dc0, and generates a CRC value of the image data Dp0 as the code CDa when the second data selection circuit 602 selects the image data Dp0. When the first expected value generation circuit 603 generates the CRC value of the command data Dc0, the generated code CDa corresponds to a first CRC expected value, and when the first expected value generation circuit 603 generates the CRC value of the image data Dp0, the generated code CDa corresponds to a second CRC expected value.

The first reception circuit 604 receives the code CDc by capturing each bit constituting the code CDc in synchronization with the clock CLK0, converts the code CDc to a code CDd which is parallel data, and outputs the code CDd. The code CDd output from the first reception circuit 604 is obtained by parallel-to-serial conversion and then serial-to-parallel conversion of the code CDb obtained in the drive signal generation circuit 400, and originally, the content thereof is to match the code CDb. That is, the code CDb and the code CDd represent the same CRC value. Although a data form is different, the code CDc is also a code representing the same CRC value as the code CDb and the code CDd.

In the present embodiment, an algorithm for the first expected value generation circuit 603 to generate the code CDa is the same as an algorithm for the first generation circuit 403 to generate the code CDb. Therefore, when the data used to generate the code CDb is the same as the data used to generate the code CDa, that is, when the drive signal generation circuit 400 receives data without an error, the codes CDb and CDd match the code CDa. Meanwhile, when an abnormality of an input terminal of the drive signal generation circuit 400, an abnormality of the image data reception circuit 201, an abnormality of the signal line from the display control circuit 500 to the data line drive circuit 200, an abnormality of the command register 401, or the like occurs, the codes CDb and CDd do not match the code CDa.

The first error detection circuit 605 includes a first comparison circuit 605*a*. The first comparison circuit 605*a* compares the code CDa generated by the first expected value generation circuit 603 with the code CDd output from the first reception circuit 604, and detects an error based on this comparison result. More specifically, the first comparison circuit 605*a* compares the code CDa and the code CDd according to the clock CLK1 generated at the timing when a predetermined time has elapsed from the timing when the first reception circuit 604 outputs the code CDd, and when the code CDa and the code CDd do not match with each other, the error signal Err1 is output. As described above, the first comparison circuit 605*a* compares the CRC value of the command data Dc0 generated by the first expected value generation circuit 603 with the CRC value of the command data Dc1 and Dc2 output from the first reception circuit 604, and further compares the CRC value of the image data Dp0 generated by the first expected value generation circuit 603 with the CRC value of the image data Dp1 output from the first reception circuit 604.

The error signal transmission circuit 606 generates a comprehensive error signal Err based on the error signal Err1 generated by the first error detection circuit 605 and other error signals generated for the drive signal generation circuit 400, and transmits the comprehensive error signal Err to the control circuit 601. In one preferable aspect, the error signal transmission circuit 606 transmits a logical sum of the error signal Err1 and the other error signals as the comprehensive error signal Err. In another preferable aspect, the error signal transmission circuit 606 transmits a signal obtained by time-multiplexing the error signal Err1 and the other error signals as the comprehensive error signal Err. In the present embodiment, details of the other error signals will be omitted.

The control circuit 601 detects an abnormality that has occurred in the drive signal generation circuit 400 or the like based on the error signal Err, and executes processing corresponding to the abnormality. Various aspects can be considered for the processing corresponding to this abnormality. For example, when an occurrence frequency of the error signal Err per unit time exceeds a predetermined threshold value, the control circuit 601 may execute control to display an error message indicating that an abnormality has occurred in the drive signal generation circuit 400 on the electro-optical panel 10. In this way, it is possible to notify a user of the abnormality of the drive signal generation circuit 400 and to perform necessary work such as repair and replacement of the circuit. As described above, the control circuit 601 controls an operation of the display circuit device 1000 based on a comparison result obtained by the first comparison circuit 605*a* and the like.

Figure 4:
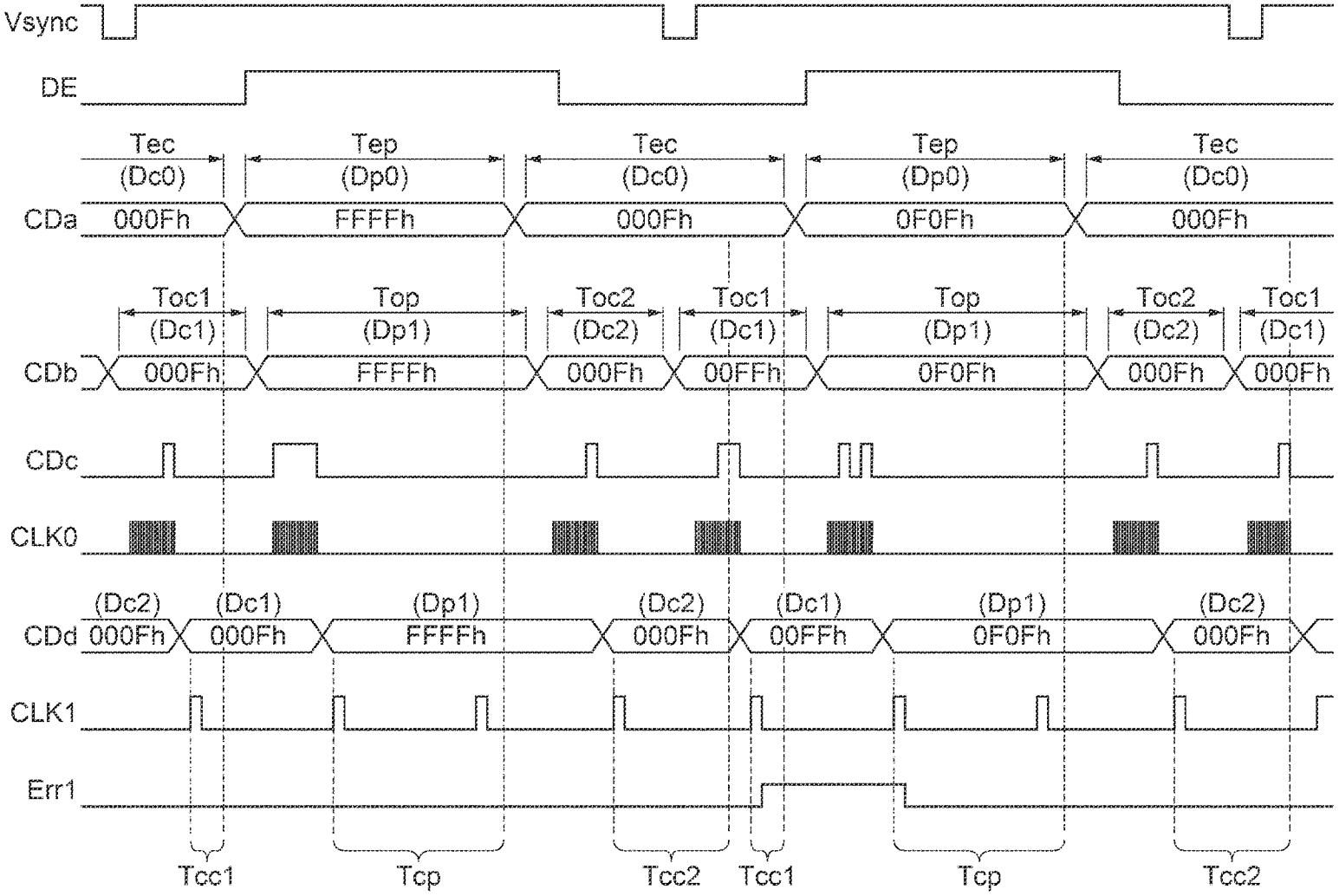
FIG. 4 is a time chart showing an example of an operation of the display circuit device.

FIG. 4 is a time chart showing an example of an operation of the display circuit device 1000 according to the present embodiment. Hereinafter, the operation according to the present embodiment will be described with reference to FIGS. 3 and 4.

In the display control circuit 500, each time the vertical synchronization signal Vsync, which is a negative pulse, is generated, the data transmission circuit 503 reads image data for one frame from the data buffer 502 and transmits the image data as the image data Dp0 to the data line drive circuit 200. While transmitting the image data Dp0 for one frame, the data transmission circuit 503 transmits a data enable signal DE at an H level indicating that the image data Dp0 is valid to the data line drive circuit 200. In the display control circuit 500, each time the vertical synchronization signal Vsync is generated, the image data Dp0 is transmitted from the data buffer 502 to the CPU 600.

In the CPU 600, the command data Dc0 transmitted from the control circuit 601 and the image data Dp0 transmitted from the data buffer 502 are input to the second data selection circuit 602. The second data selection circuit 602 sequentially selects the command data Dc0 and the image data Dp0 according to the elapsed time from the generation of the vertical synchronization signal Vsync, and transmits the selected data as the target data Do2 to the first expected value generation circuit 603. The first expected value generation circuit 603 sequentially generates the code CDa from the transmitted target data Do2.

In an example shown in FIG. 4, the image data Dp0 is selected by the second data selection circuit 602 in synchronization with the generation of the first vertical synchronization signal Vsync, and FFFFh is generated as the code CDa of the image data Dp0 for one frame by the first expected value generation circuit 603. After that, the command data Dc0 is selected by the second data selection circuit 602, and 000Fh is generated as the code CDa of the command data Dc0 by the first expected value generation circuit 603. Here, h means hexadecimal notation. The code CDa is 16-bit parallel data. Further, the image data Dp0 is selected again by the second data selection circuit 602 in synchronization with the generation of the second vertical synchronization signal Vsync, and 0F0Fh is generated as the code CDa of the image data Dp0 for the next one frame by the first expected value generation circuit 603. After that, the command data Dc0 is selected by the second data selection circuit 602, and 000Fh is generated as the code CDa of the command data Dc0 by the first expected value generation circuit 603. After that, the above operation is repeated.

In FIG. 4, a period Tec is a period during which the first expected value generation circuit 603 generates the CRC value of the command data Dc0 as the code CDa. A period Tep is a period during which the first expected value generation circuit 603 generates the CRC value of the image data Dp0 as the code CDa.

In the drive signal generation circuit 400, each time the vertical synchronization signal Vsync is generated, the image data reception circuit 201 receives the image data Dp0 for one frame transmitted from the display control circuit 500 while the data enable signal DE is at the H level. The command register 401 receives the command data Dc0 from the CPU 600 via the display control circuit 500.

The first data selection circuit 402 sequentially selects the image data Dp1 from the image data reception circuit 201, the command data Dc1 before being stored in the command register 401, and the command data Dc2 read from the command register 401 according to the elapsed time from the generation of the vertical synchronization signal Vsync, and transmits the selected data as the target data Do1 to the first generation circuit 403. Each time the first generation circuit 403 receives the target data Do1 from the first data selection circuit 402, the first generation circuit 403 generates the code CDb. Similar to the code CDa, the code CDb is 16-bit parallel data.

Each time the first generation circuit 403 generates the code CDb, the first transmission circuit 404 converts the code CDb into the code CDc that is a 16-bit serial bit string, and transmits each bit of the code CDc to the CPU 600 in synchronization with the clock CLK0.

In the example shown in FIG. 4, the command data Dc1 is selected by the first data selection circuit 402 in synchronization with the generation of the first vertical synchronization signal Vsync, and 000Fh is generated as the code CDb by the first generation circuit 403. Next, the image data Dp1 is selected by the first data selection circuit 402, and FFFFh is generated as the code CDb of the image data Dp1 for one frame by the first generation circuit 403. After that, the command data Dc2 is selected by the first data selection circuit 402, and 000Fh is generated as the code CDb by the first generation circuit 403. Similarly, the command data Dc1 is selected by the first data selection circuit 402 in synchronization with the generation of the second vertical synchronization signal Vsync, and 00FFh is generated as the code CDb by the first generation circuit 403. Next, the image data Dp1 is selected by the first data selection circuit 402, and 0F0Fh is generated as the code CDb of the image data Dp1 for the next one frame by the first generation circuit 403. After that, the command data Dc2 is selected by the first data selection circuit 402, and 000Fh is generated as the code CDb by the first generation circuit 403. After that, the above operation is repeated. The code CDb generated by the first generation circuit 403 is converted to the code CDc which is a serial bit string by the first transmission circuit 404.

In FIG. 4, periods Toc1 and Toc2 are periods during which the first generation circuit 403 generates the CRC values of the command data Dc1 and Dc2 as the code CDb. A period Top is a period during which the first generation circuit 403 generates the CRC value of the image data Dp1 as the code CDb. With respect to the periods Toc1 and Toc2, the period Toc1 is a period during which the first generation circuit 403 generates, as the code CDb, the CRC value of the command data Dc1 before being stored in the command register 401, and the period Toc2 is a period during which the first generation circuit 403 generates, as the code CDb, the CRC value of the command data Dc2 stored in the command register 401.

In the CPU 600, the first reception circuit 604 receives the code CDc by capturing each bit constituting the code CDc in synchronization with the clock CLK0, and outputs the code CDc as the code CDd which is the 16-bit parallel data. The code CDd corresponds to the code CDb generated by the first generation circuit 403 of the drive signal generation circuit 400.

In the example shown in FIG. 4, in synchronization with the generation of the first vertical synchronization signal Vsync, from the first reception circuit 604, 000Fh, which is the CRC value of the command data Dc1, is output as the code CDd, then FFFFh, which is the CRC value of the image data Dp1, is output, and then 000Fh, which is the CRC value of the command data Dc2, is output. Similarly, in synchronization with the generation of the second vertical synchronization signal Vsync, from the first reception circuit 604, 00FFh, which is the CRC value of the command data Dc1, is output as the code CDd, then 0F0Fh, which is the CRC value of the image data Dp1, is output, and then 000Fh, which is the CRC value of the command data Dc2, is output. After that, the above operation is repeated.

The first comparison circuit 605*a* of the first error detection circuit 605 compares the code CDa output by the first expected value generation circuit 603 with the code CDd output by the first reception circuit 604 by the clock CLK1 being given, and outputs the error signal Err1 at the H level when the codes CDa and CDd do not match with each other.

In the example shown in FIG. 4, the first comparison circuit 605*a* compares the code CDa of the command data Dc0 with the code CDd of the command data Dc1 in the period Tcc1 after the code CDd of the command data Dc1 is output, and then compares the code CDa of the image data Dp0 with the code CDd of the image data Dp1 in a period Tcp after the code CDd of the image data Dp1 is output. Further, the first comparison circuit 605*a* compares the code CDa of the command data Dc0 with the code CDd of the command data Dc2 in the period Tcc2 after the code CDd of the command data Dc2 is output. Then, in comparison in the second period Tcc1, the code CDa output from the first expected value generation circuit 603 is 000Fh, whereas the code CDd output by the first reception circuit 604 is 00FFh. The code CDa and the code CDd do not match with each other. Therefore, the first comparison circuit 605*a* outputs the error signal Err1 at the H level. The content of the error signal Err1 is notified to the control circuit 601 by the error signal Err from the error signal transmission circuit 606. As described above, in the present embodiment, when an error occurs in the image data Dp1 and the command data Dc1 and Dc2 that are received by the drive signal generation circuit 400, the error is notified to the control circuit 601, and the control according to the content of the error is executed by the control circuit 601.

As described above, according to the display circuit device 1000 in the present embodiment, since the error is detected for the command data Dc1 and Dc2 using the CRC, a malfunction caused by the error in the command data Dc1 and Dc2 can be prevented.

According to the display circuit device 1000 in the present embodiment, errors are detected for both the command data Dc1 before being stored in the command register 401 and the command data Dc2 stored in the command register 401, and thus the abnormality of a route of the command data Dc0 to the command register 401 and the abnormality of the command register 401 itself can be detected separately.

According to the display circuit device 1000 in the present embodiment, the error is detected also for the image data Dp1 using the CRC, and thus display disturbance caused by the error of the image data Dp1 can be prevented.

According to the display circuit device 1000 in the present embodiment, the error detection of the command data Dc1 and Dc2 and the error detection of the image data Dp1 are executed using a common circuit, and thus an increase in size of the circuit can be prevented.

B. Second Embodiment

The display circuit device 1000 according to a second embodiment is different from that according to the first embodiment in that a configuration for detecting the error is provided not in the CPU 600 but in the display control circuit 500.

Figure 5:
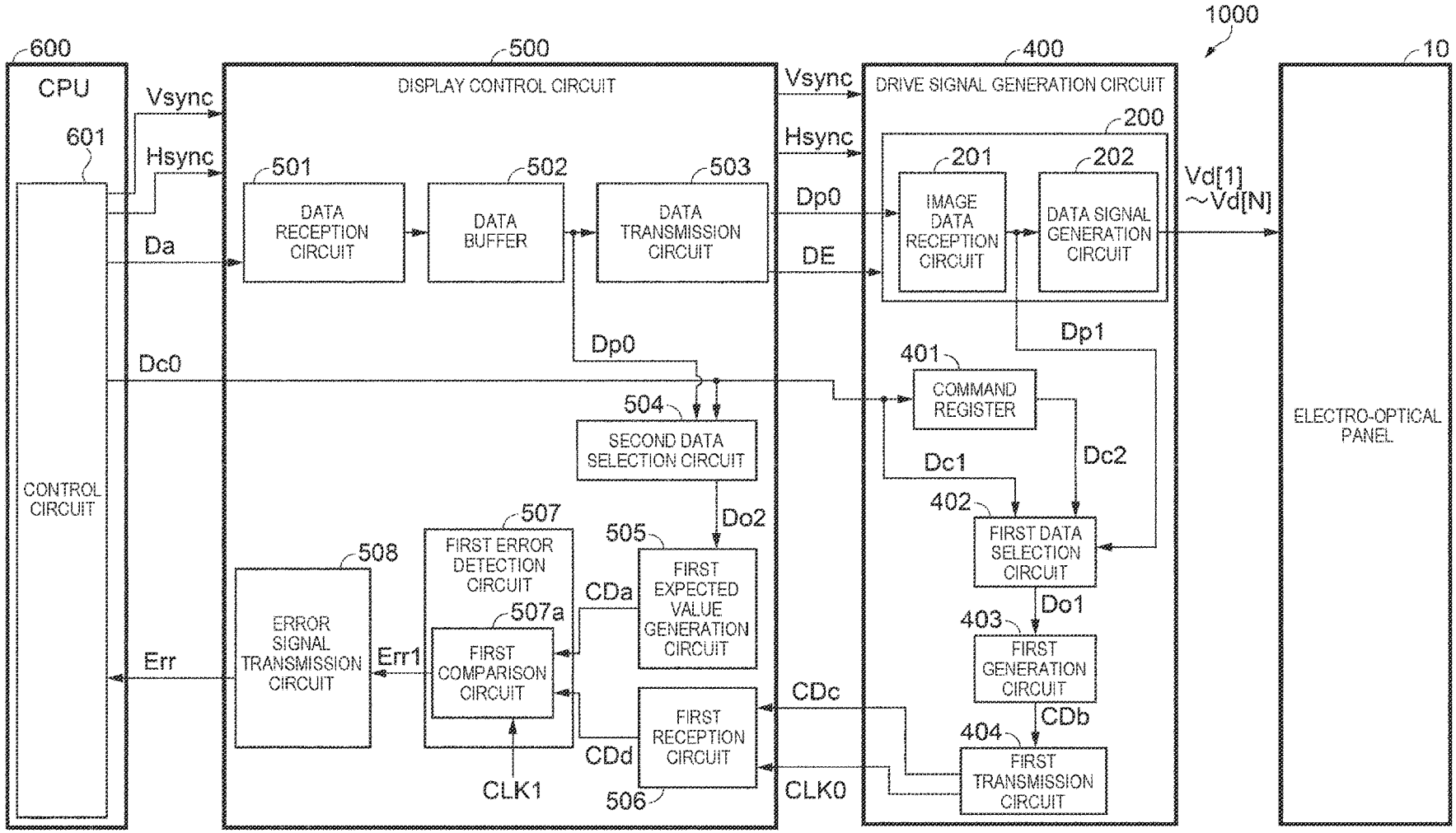
FIG. 5 is a block diagram showing a configuration of a display circuit device according to a second embodiment.

FIG. 5 is a block diagram showing a configuration of the display circuit device 1000 according to the second embodiment.

As shown in FIG. 5, the display control circuit 500 according to the present embodiment includes a second data selection circuit 504, a first expected value generation circuit 505, a first reception circuit 506, a first error detection circuit 507, and an error signal transmission circuit 508 in addition to the data reception circuit 501, the data buffer 502, and the data transmission circuit 503. These circuits have the same functions as those of the second data selection circuit 602, the first expected value generation circuit 603, the first reception circuit 604, the first error detection circuit 605, and the error signal transmission circuit 606 according to the first embodiment. The first error detection circuit 507 includes a first comparison circuit 507*a*, and the first comparison circuit 507*a* has the same function as the first comparison circuit 605*a* according to the first embodiment.

With such a configuration, the same effect as that according to the first embodiment can be attained.

C. Third Embodiment

Similar to the first embodiment, the display circuit device 1000 according to the third embodiment includes the configuration for detecting the error in the CPU 600, but is different from that according to the first embodiment in that different circuits are used for the image data Dp1 and the command data Dc1 and Dc2 for the generation of the CRC value in the drive signal generation circuit 400 and the detection of the error in the CPU 600.

Figure 6:
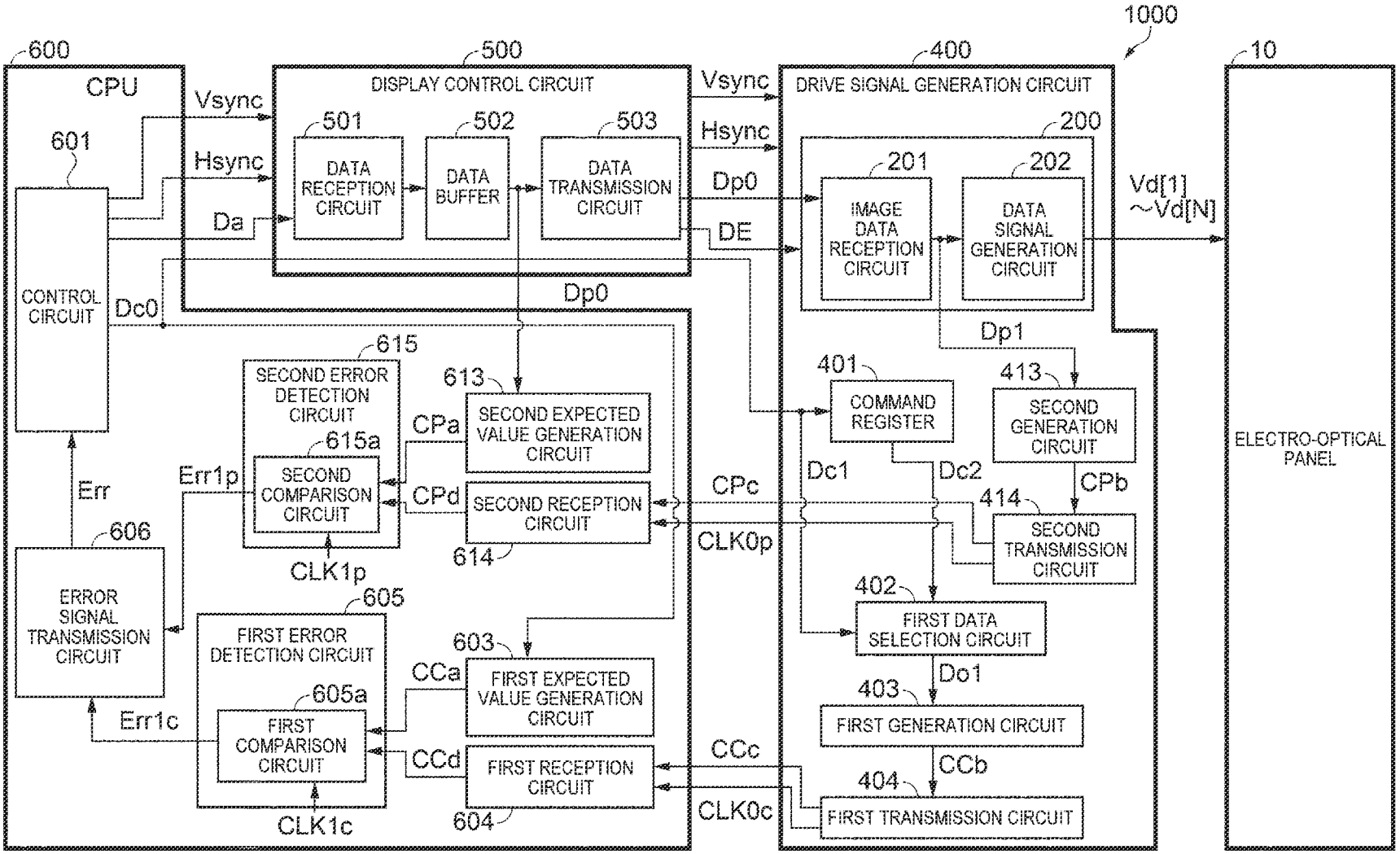
FIG. 6 is a block diagram showing a configuration of a display circuit device according to a third embodiment.

FIG. 6 is a block diagram showing a configuration of the display circuit device 1000 according to the third embodiment.

As shown in FIG. 6, the drive signal generation circuit 400 according to the present embodiment includes a second generation circuit 413 and a second transmission circuit 414 in addition to the command register 401, the first data selection circuit 402, the first generation circuit 403, and the first transmission circuit 404 according to the first embodiment. The image data Dp1 received by the image data reception circuit 201 is input to the second generation circuit 413. The second generation circuit 413 generates a code CPb, which is a CRC value for the error detection, from the image data Dp1. Each time the second generation circuit 413 generates the code CPb, the second transmission circuit 414 converts the code CPb to a code CPc which is a serial bit string, and transmits each bit constituting the code CPc to the CPU 600 in synchronization with a clock CLK0*p*. The code CPb generated by the second generation circuit 413 corresponds to the second CRC value.

The command data Dc1 before being stored in the command register 401 and the command data Dc2 stored in the command register 401 and read from the command register 401 are input to the first data selection circuit 402 according to the present embodiment, and the image data Dp1 is not input to the first data selection circuit 402. Then, the first data selection circuit 402 selects one of the command data Dc1 and the command data Dc2 according to the elapsed time from the generation of the vertical synchronization signal Vsync, and outputs the selected data as the target data Do1 to the first generation circuit 403. The first generation circuit 403 generates a code CCb, which is a CRC value for error detection, based on the target data Do1 output from the first data selection circuit 402. Each time the first generation circuit 403 generates the code CCb, the first transmission circuit 404 converts the code CCb to a code CCc which is a serial bit string, and transmits each bit constituting the code CCc to the CPU 600 in synchronization with a clock CLK0*c*. The code CCb generated by the first generation circuit 403 corresponds to the first CRC value.

The CPU 600 according to the present embodiment includes a second expected value generation circuit 613, a second reception circuit 614, and a second error detection circuit 615 in addition to the control circuit 601, the first expected value generation circuit 603, the first reception circuit 604, the first error detection circuit 605, and the error signal transmission circuit 606 that are described above. The CPU 600 does not include the second data selection circuit 602.

The second expected value generation circuit 613 acquires the image data Dp0 for one frame from the data buffer 502 and generates a code CPa, which is a CRC value. The second reception circuit 614 receives the code CPc by capturing each bit constituting the code CPc in synchronization with the clock CLK0*p*, converts the code CPc into the code CPd which is the parallel data, and outputs the code CPd. The code CPd is obtained by parallel-to-serial conversion and then serial-to-parallel conversion of the code CPb obtained in the drive signal generation circuit 400, and originally, the content thereof is to match the code CPb. The code CPa generated by the second expected value generation circuit 613 corresponds to the second CRC expected value.

The second error detection circuit 615 includes a second comparison circuit 615*a*. The second comparison circuit 615*a* compares the code CPa generated by the second expected value generation circuit 613 with the code CPd output from the second reception circuit 614, and detects the error based on this comparison result. More specifically, the second comparison circuit 615*a* compares the code CPa and the code CPd according to the clock CLK1*p* generated at the timing when a predetermined time has elapsed from the timing when the second reception circuit 614 outputs the code CPd, and when the code CPa and the code CPd do not match with each other, an error signal Errp1 is output.

The first expected value generation circuit 603 according to the present embodiment acquires the command data Dc0 transmitted toward the drive signal generation circuit 400 and generates a code CCa which is a CRC value. The code CCa corresponds to the first CRC expected value. The first reception circuit 604 receives the code CCc by capturing each bit constituting the code CCc in synchronization with the clock CLK0*c*, converts the code CCc into the code CCd which is the parallel data, and outputs the code CCd. The code CCd is obtained by parallel-to-serial conversion and then serial-to-parallel conversion of the code CCb obtained in the drive signal generation circuit 400, and originally, the content thereof is to match the code CCb.

The first error detection circuit 605 includes the first comparison circuit 605*a*. The first comparison circuit 605*a* compares the code CCa generated by the first expected value generation circuit 603 with the code CCd output from the first reception circuit 604, and detects an error based on this comparison result. More specifically, the first comparison circuit 605*a* compares the code CCa and the code CCd according to the clock CLK1*c* generated at the timing when a predetermined time has elapsed from the timing when the first reception circuit 604 outputs the code CCd, and when the code CCa and the code CCd do not match with each other, an error signal Err1*c* is output.

The error signal transmission circuit 606 generates the comprehensive error signal Err based on the error signal Err1*c* generated by the first error detection circuit 605, the error signal Errp1 generated by the second error detection circuit 615, and other error signals generated for the drive signal generation circuit 400, and transmits the comprehensive error signal Err to the control circuit 601. The control circuit 601 detects the abnormality that has occurred in the drive signal generation circuit 400 or the like based on the error signal Err, and executes the processing corresponding to the abnormality. As described above, the control circuit 601 controls an operation of the display circuit device 1000 based on a comparison result obtained by the first comparison circuit 605*a* and a comparison result obtained by the second comparison circuit 615*a*.

With such a configuration, the same effect as that according to the first embodiment can be attained.

D. Fourth Embodiment

Similar to the third embodiment, the display circuit device 1000 according to a fourth embodiment uses different circuits for the image data Dp1 and the command data Dc1 and Dc2 for the generation of the CRC value and the detection of the error, but is different from that according to the third embodiment in that the display control circuit 500 is provided with the configuration for the error detection.

Figure 7:
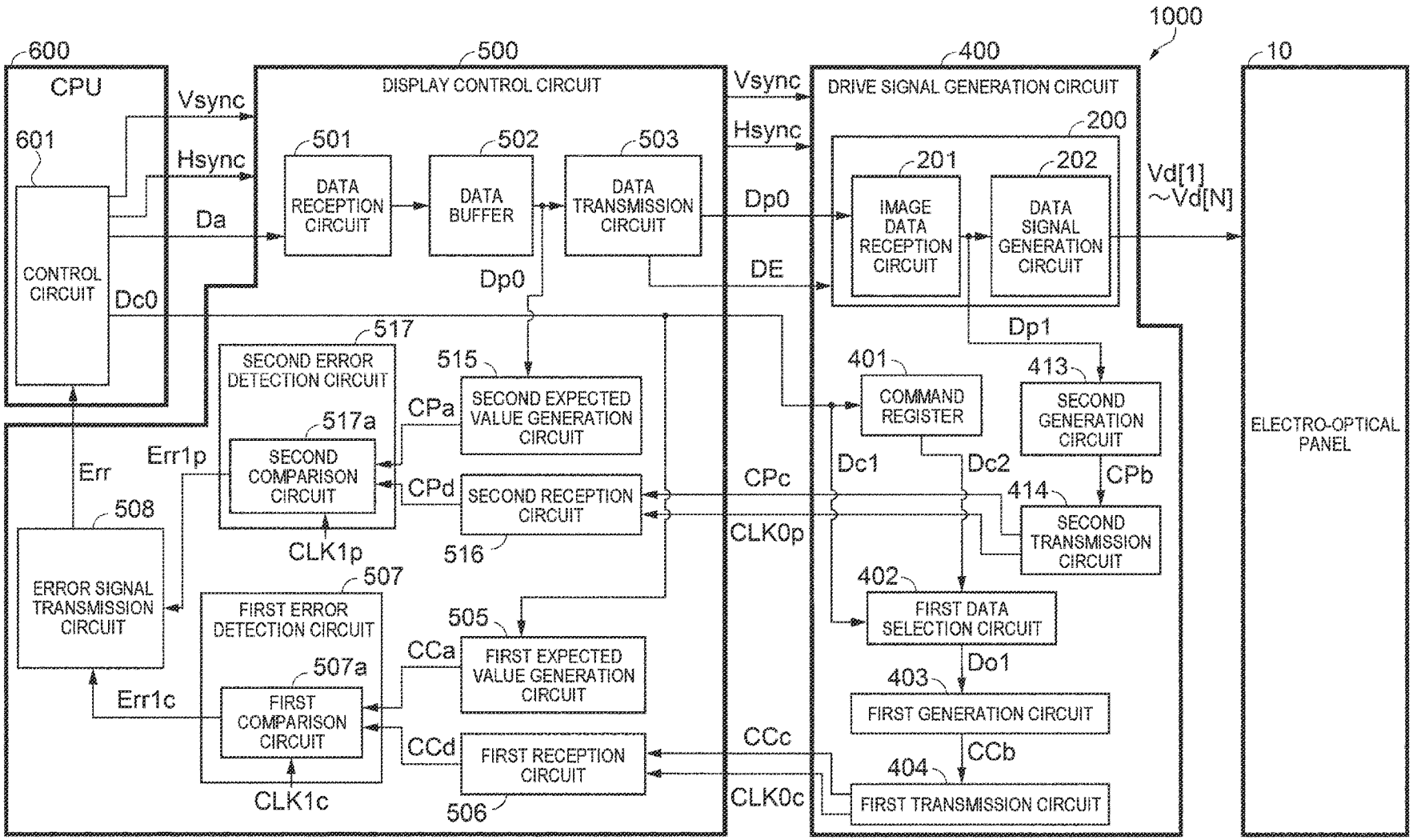
FIG. 7 is a block diagram showing a configuration of a display circuit device according to a fourth embodiment.

FIG. 7 is a block diagram showing a configuration of the display circuit device 1000 according to the fourth embodiment.

As shown in FIG. 7, the drive signal generation circuit 400 according to the present embodiment has the same configuration as the drive signal generation circuit 400 according to the third embodiment.

The display control circuit 500 according to the present embodiment includes the first expected value generation circuit 505, the first reception circuit 506, the first error detection circuit 507, the error signal transmission circuit 508, a second expected value generation circuit 515, a second reception circuit 516, and a second error detection circuit 517 in addition to the data reception circuit 501, the data buffer 502, and the data transmission circuit 503. These circuits have the same functions as those of the first expected value generation circuit 603, the first reception circuit 604, the first error detection circuit 605, and the error signal transmission circuit 606, the second expected value generation circuit 613, the second reception circuit 614, and the second error detection circuit 615 according to the third embodiment. The first error detection circuit 507 includes the first comparison circuit 507*a*, and the second error detection circuit 517 includes a second comparison circuit 517*a*. The first comparison circuit 507*a* and the second comparison circuit 517*a* have the same functions as those of the first comparison circuit 605*a* and the second comparison circuit 615*a* according to the third embodiment, respectively.

With such a configuration, the same effect as that according to the first embodiment can be attained.

E. Other Embodiments

Although the embodiments are described above, there may be other embodiments. For example, the following may be executed.

Figure 8:
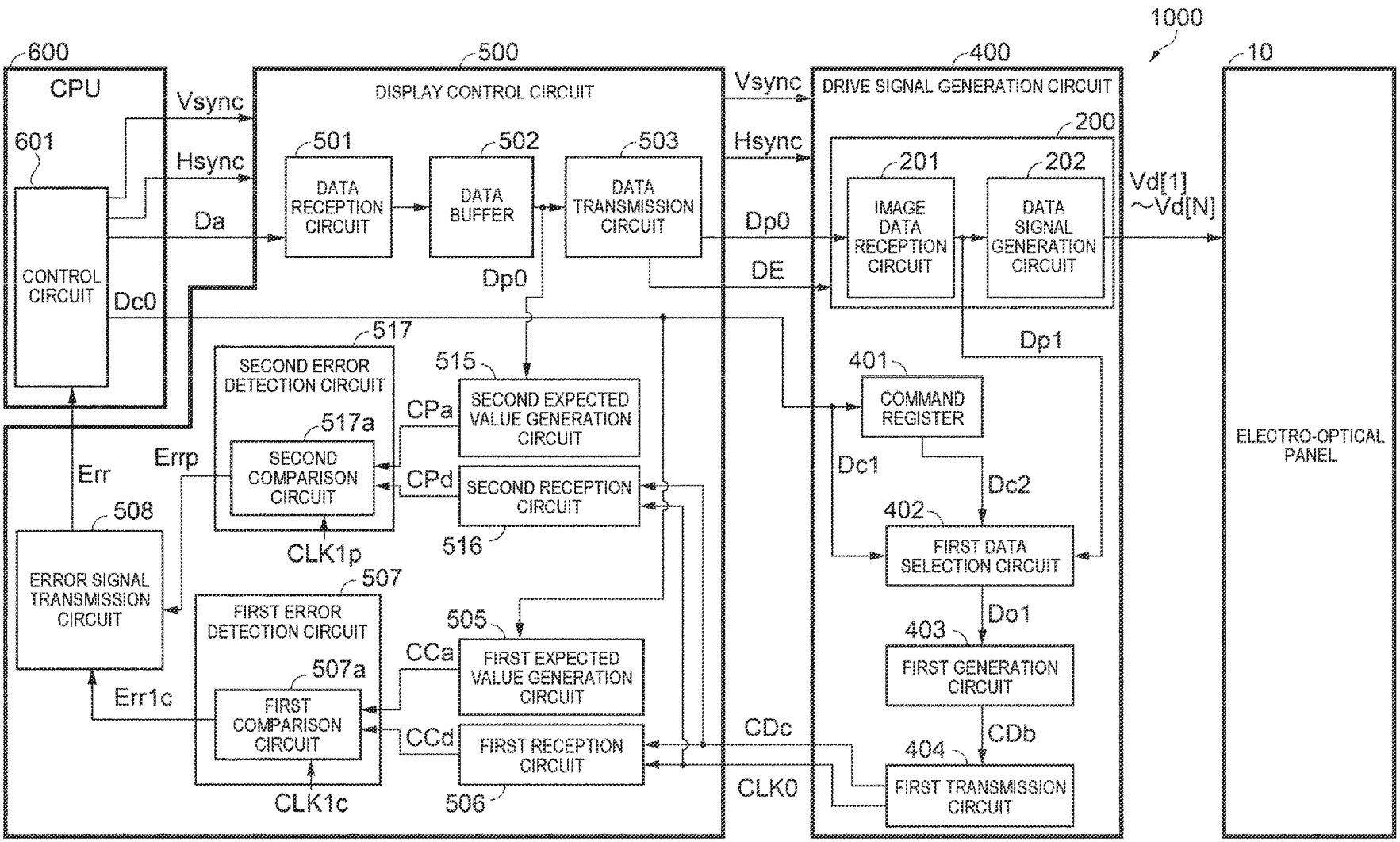
FIG. 8 is a block diagram showing a configuration of a display circuit device according to another embodiment.
Figure 9:
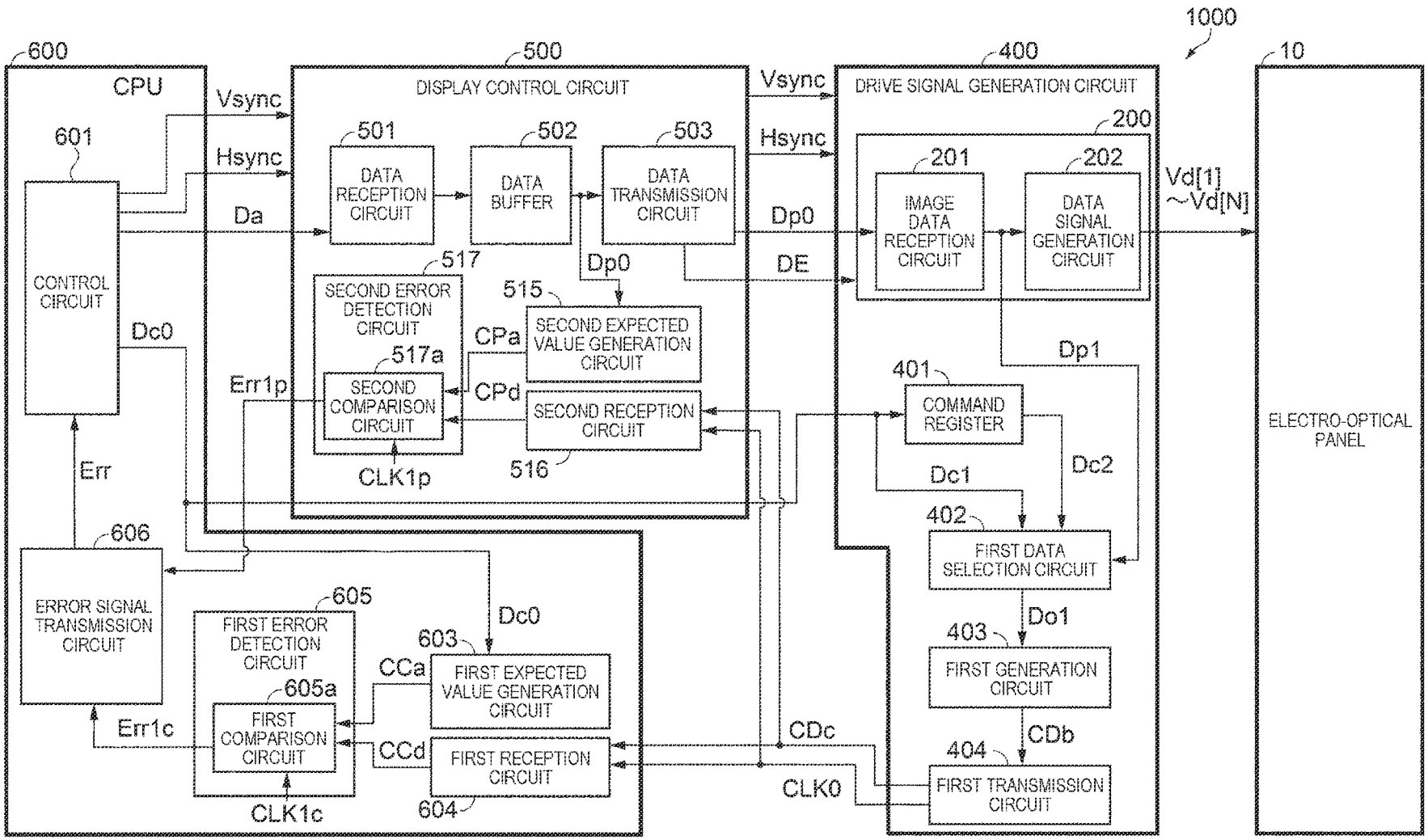
FIG. 9 is a block diagram showing a configuration of a display circuit device according to another embodiment.

(1) In the above embodiments, a common circuit may be used for the image data Dp1 and the command data Dc1 and Dc2 for the generation of the CRC value in the drive signal generation circuit 400. Alternatively, a different circuit may be used for the image data Dp1 and the command data Dc1 and Dc2 for the error detection. For example, FIG. 8 shows a configuration in which both a circuit that detects an error in the image data Dp1 and a circuit that detects an error in the command data Dc1 and Dc2 are provided in the display control circuit 500. Although not shown, the CPU 600 may include both the circuit that detects the error in the image data Dp1 and the circuit that detects the error in the command data Dc1 and Dc2. For example, FIG. 9 shows a configuration in which the display control circuit 500 includes the circuit that detects the error in the image data Dp1, and the CPU 600 includes the circuit that detects the error in the command data Dc1 and Dc2. Although not shown, for the generation of the CRC value in the drive signal generation circuit 400, different circuits may be used for the image data Dp1 and the command data Dc1 and Dc2. Alternatively, for the error detection, the common circuit may be used for the image data Dp1 and the command data Dc1 and Dc2.

(2) In the above embodiments, the CRC value of the command data Dc1 and the CRC value of the command data Dc2 are generated by the common first generation circuit 403 and transmitted by the common first transmission circuit 404. Alternatively, the generation circuit and the transmission circuit may be individually provided with the command data Dc1 and the command data Dc2. When this configuration is adopted in the third and fourth embodiments using different generation circuits for the command data Dc1 and Dc2 and the image data Dp1, the first data selection circuit 402 is unnecessary.

Figure 10:
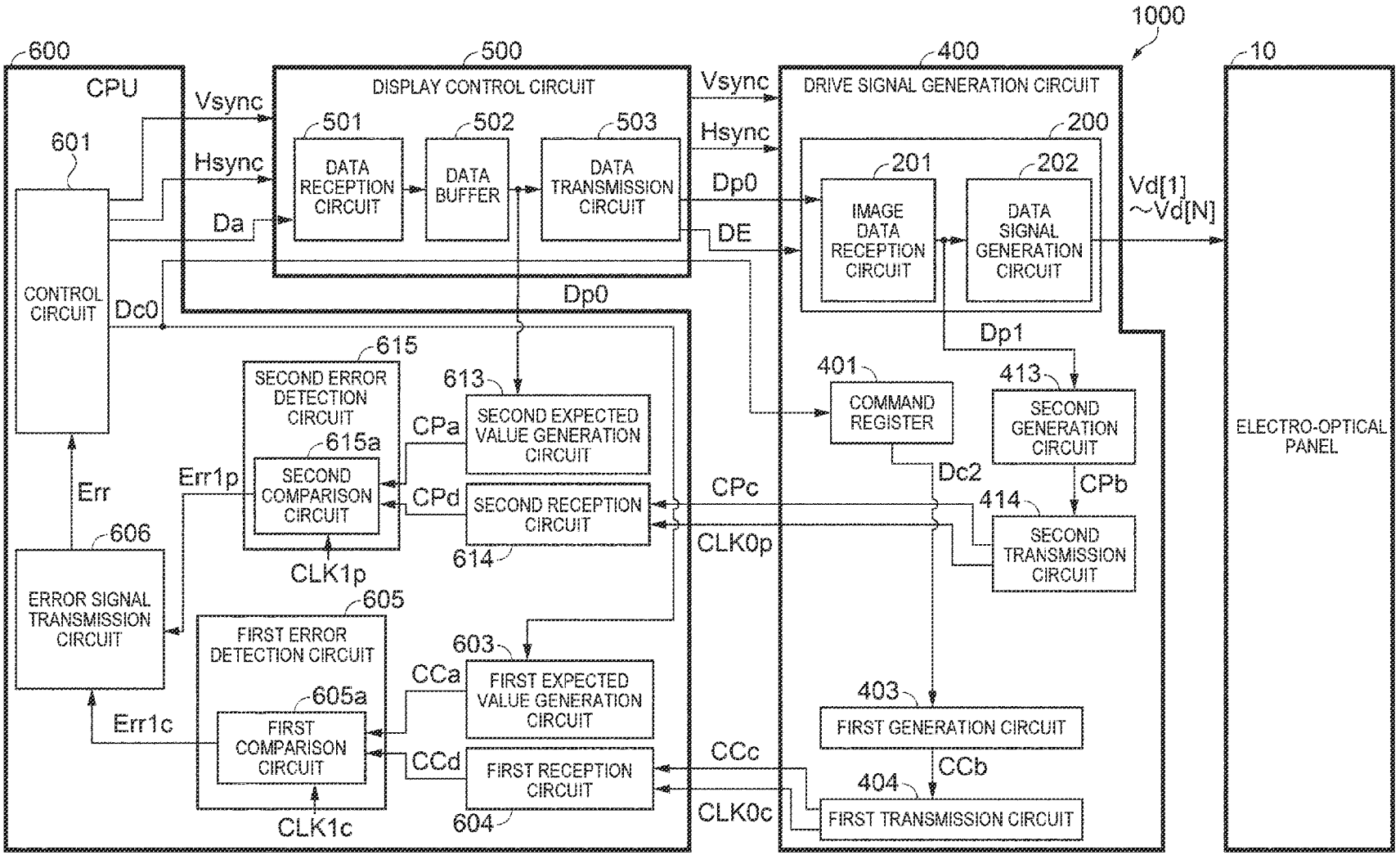
FIG. 10 is a block diagram showing a configuration of a display circuit device according to another embodiment.

(3) In the above embodiments, the configuration has been described in which both the errors of the command data Dc1 and the command data Dc2 can be detected. Alternatively, a configuration may be used in which only one of the errors can be detected. For example, FIG. 10 shows a configuration in which only the error of the command data Dc2 read from the command register 401 can be detected in the display circuit device 1000 according to the third embodiment. As described above, when this configuration is adopted in the third and fourth embodiments, the first data selection circuit 402 is unnecessary.

(4) In the above embodiments, the configuration for detecting the error of the image data Dp1 is not an indispensable configuration, and any configuration may be used as long as the errors in the command data Dc1 and Dc2 can be detected.

(5) In the above embodiments, the drive signal generation circuit 400 may execute various types of setting based on the input command data Dc0 without storing the command data Dc0 received from the control circuit 601 in the command register 401. In this case, the command register 401 is unnecessary.

(6) In the above embodiments, the CRC value is generated based on the image data Dp0 and Dp1 in units of one frame. Alternatively, the units of the image data Dp0 and Dp1 for generating the CRC value may be any unit, and the CRC value may be generated based on the image data Dp0 and Dp1 in units of one line.

(7) In the above embodiments, the algorithm for the first expected value generation circuit 603 to generate the code CDa and the algorithm for the first generation circuit 403 to generate the code CDb are the same, and first comparison circuit 605*a* detects the errors in the image data Dp1 and the command data Dc1 and Dc2 that are received by the drive signal generation circuit 400 by comparing the code CDa with the code CDd corresponding to the code CDb. Alternatively, the algorithm for generating the code CDa and the algorithm for generating the code CDb may not be the same. For example, an algorithm for generating the code CDb may be determined such that the code CDb having the same absolute value as the code CDa and an opposite sign to the code CDa is generated. In this case, the first error detection circuit 605 may generate the error signal Err1 when the sum of the code CDa and the code CDd corresponding to the code CDb is a numerical value other than 0. As described above, the first error detection circuit 605 may detect the errors in the image data Dp1 and the command data Dc1 and Dc2 that are received by the drive signal generation circuit 400 based on the code CDa and the code CDd.

(8) In the above embodiments, the liquid crystal display panel is used as the electro-optical panel 10, but the embodiments are not limited thereto. For example, the embodiments are also applicable to the electro-optical device 1 including the electro-optical panel 10 other than the liquid crystal display panel, such as a display panel including a light-emitting element such as an organic light-emitting diode (OLED) or a display panel including an electrophoretic element.

By appropriately combining the above first to fourth embodiments and the above other embodiments (1) to (8), the display circuit device 1000 according to various aspects can be implemented. For example, it is also possible to adopt an aspect in which the error in the image data Dp1 is not detected and none of the command register 401, the first data selection circuit 402, and the second data selection circuits 504 and 602 is provided.

F. Application Example

The electro-optical device 1 exemplified in each of the embodiments described above can be used in various types of electronic apparatuses. FIGS. 11 to 14 illustrate specific embodiments of the electronic apparatus employing the electro-optical device 1.

Figure 11:
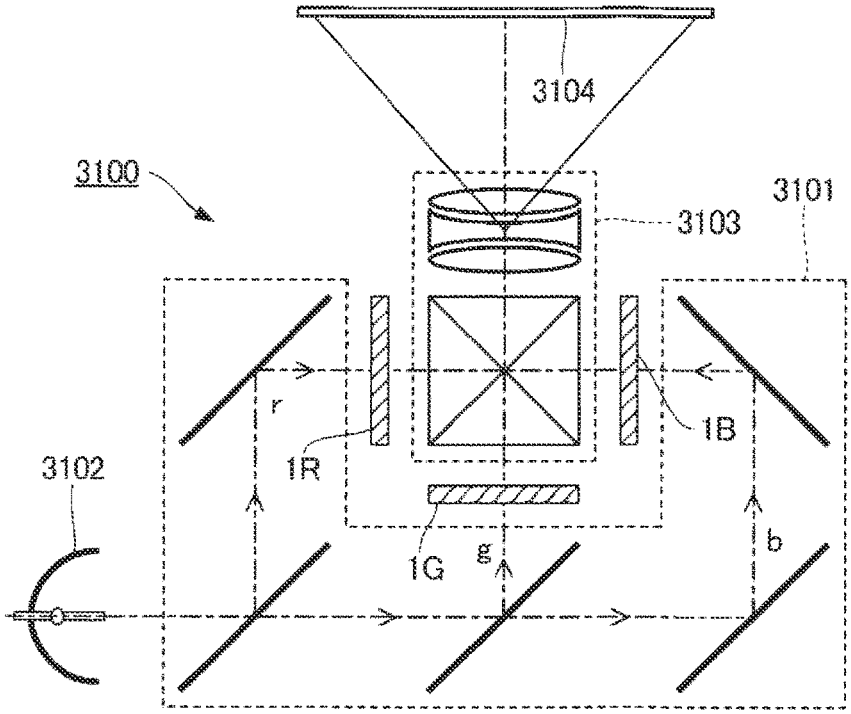
FIG. 11 is a schematic view of a projection type display device as an application example.

FIG. 11 is a schematic diagram of a projection type display device 3100 to which electro-optical devices 1R, 1G, and 1B having the same configuration as that of the electro-optical device 1 described above are applied. The projection type display device 3100 includes three electro-optical devices 1R, 1G, and 1B corresponding to different display colors, specifically red, green, and blue. An illumination optical system 3101 supplies a red component r of emitted light from an illumination device 3102 to the electro-optical device 1R, supplies a green component g of the emitted light to the electro-optical device 1G, and supplies a blue component b of the emitted light to the electro-optical device 1B. The electro-optical devices 1R, 1G, and 1B function as optical modulators that modulate monochromatic light supplied from the illumination optical system 3101 according to a display image. A projection optical system 3103 synthesizes the emitted light from the electro-optical devices 1R, 1G, and 1B and projects the light to a projection surface 3104. An observer visually recognizes an image projected on the projection surface 3104.

Figure 12:
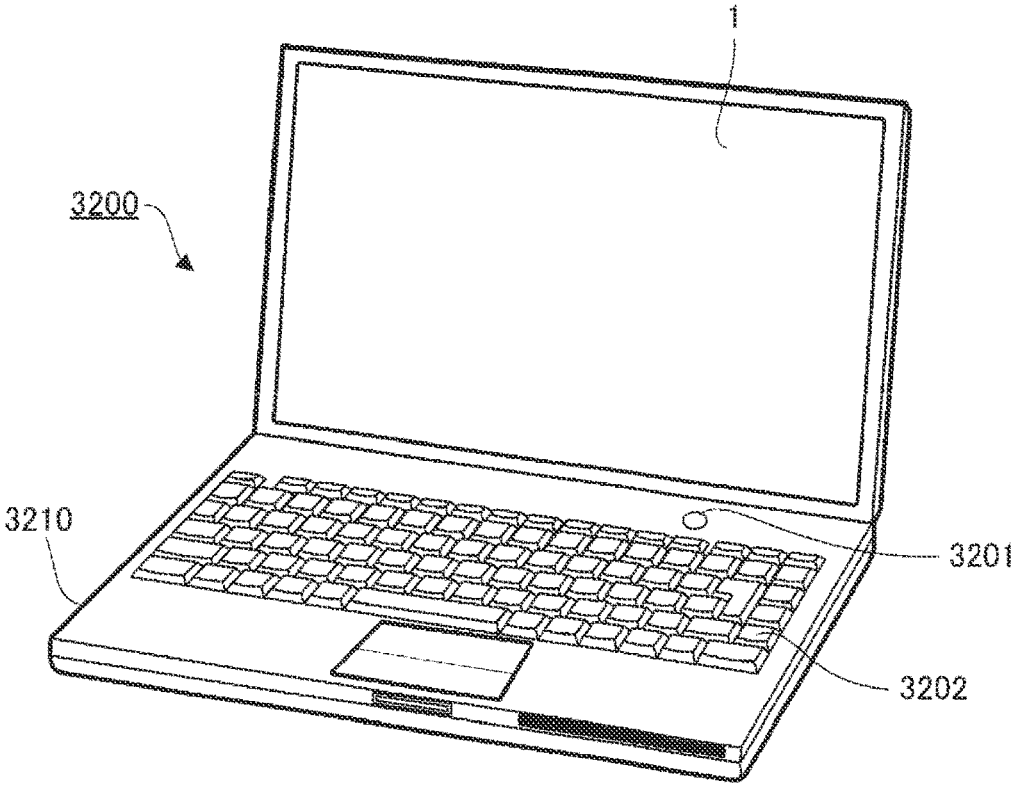
FIG. 12 is a perspective view of a personal computer as an application example.

FIG. 12 is a perspective view of a portable personal computer 3200 using the electro-optical device 1. The personal computer 3200 includes the electro-optical device 1 that displays various images, and a main body 3210 on which a power supply switch 3201 and a keyboard 3202 are provided.

Figure 13:
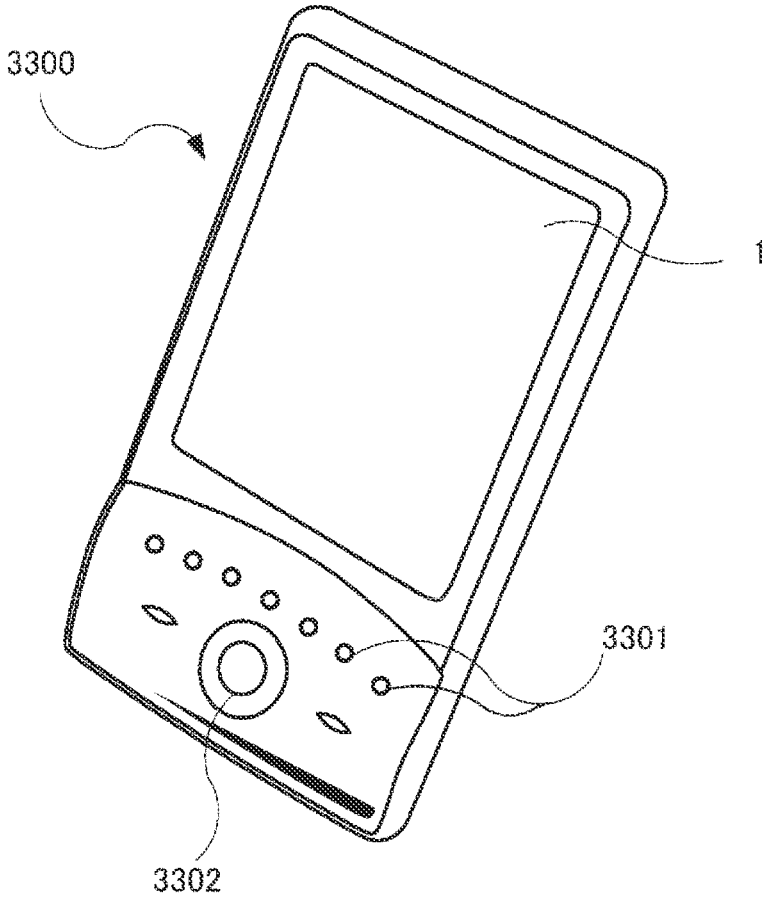
FIG. 13 is a diagram showing a configuration example of a mobile information terminal as an application example.

FIG. 13 is a diagram showing a configuration example of a personal digital assistant (PDA) 3300 to which the electro-optical device 1 is applied. The personal digital assistant 3300 includes a plurality of operation buttons 3301, a power supply switch 3302, and the electro-optical device 1 as a display unit. When the power supply switch 3302 is operated, various types of information such as an address book and a schedule book are displayed on the electro-optical device 1.

Examples of the electronic apparatus to which the electro-optical device 1 is applied include, in addition to the apparatus illustrated in FIGS. 11 to 13, a digital still camera, a television, a video camera, an electronic notebook, electronic paper, a calculator, a word processor, a workstation, a videophone, a point of sale system (POS) terminal, a printer, a scanner, a copier, a video player, and an apparatus provided with a touch panel.

Figure 14:
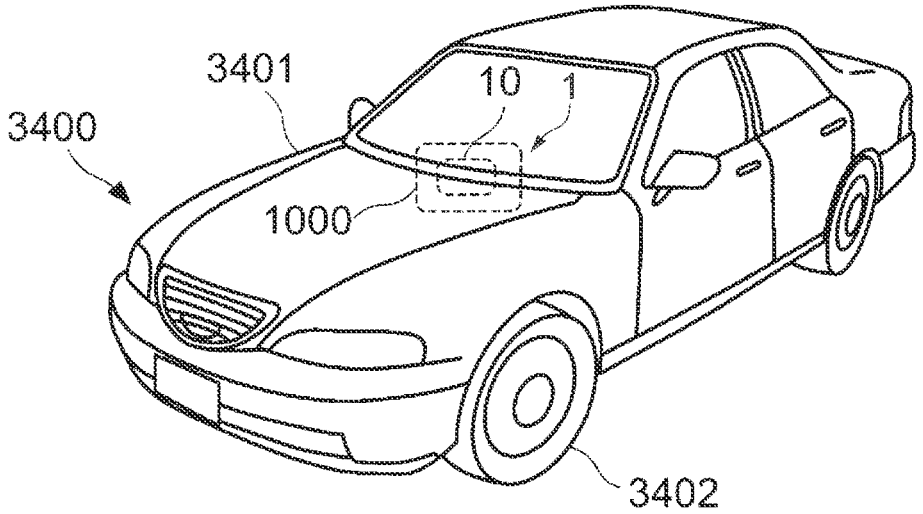
FIG. 14 is a diagram showing a configuration example of a moving body as an application example.

FIG. 14 is a diagram showing a configuration example of a moving body to which the electro-optical device 1 is applied. The moving body is, for example, an apparatus or a device that includes a drive mechanism such as an engine or a motor, a steering mechanism such as a steering wheel or a rudder, and various types of electronic apparatuses, and moves on a ground, a sky, and a sea. As the moving body, for example, a car, an airplane, a motorcycle, a ship, and a robot can be assumed. FIG. 14 schematically shows an automobile 3400 as a specific example of the moving body. The automobile 3400 includes a vehicle body 3401 and wheels 3402. The electro-optical device 1 including the electro-optical panel 10 and the display circuit device 1000 is incorporated in the automobile 3400. The display circuit device 1000 may include, for example, an electronic control unit (ECU). The electro-optical panel 10 is a panel apparatus such as a meter panel. The display circuit device 1000 generates an image to be presented to a user, and displays the image on the electro-optical panel 10. For example, information such as a vehicle speed, a remaining fuel amount, a travel distance, and setting of various devices is displayed as the image.

What is claimed is:

1. A display circuit device comprising:

a processing device;

a display control circuit; and a drive circuit to which command data is received from the processing device and image data and a control signal is received from the display control circuit, and the drive circuit is configured to drive a display panel based on the image data and the command data, wherein the drive circuit includes:

a first generation circuit configured to generate a first CRC value that is a CRC value of the command data received from the processing device; and a first transmission circuit configured to transmit the first CRC value to the processing device, the processing device includes:

a first expected value generation circuit configured to generate a first CRC expected value that is a CRC value of the command data before being input to the drive circuit;

a first reception circuit configured to receive the first CRC value transmitted by the first transmission circuit;

a first comparison circuit configured to compare the first CRC expected value generated by the first expected value generation circuit with the first CRC value received by the first reception circuit; and a control circuit configured to execute control based on a comparison result between the first CRC expected value and the first CRC value, the comparison result being obtained by the first comparison circuit, and the command data is data for setting an operation of the drive circuit, the image data includes data that defines a gradation to be displayed in each pixel circuit of the display panel, and the control signal includes a synchronization signal.

2. The display circuit device according to claim 1, wherein the drive circuit includes:

a command register configured to store the command data received from the processing device; and a first selection circuit configured to select one of first command data that is command data before being stored in the command register and second command data that is command data stored in the command register and output the selected command data, and the first generation circuit generates a CRC value of the first command data as the first CRC value when the first selection circuit selects the first command data, and generates a CRC value of the second command data as the first CRC value when the first selection circuit selects the second command data.

3. The display circuit device according to claim 1, wherein the drive circuit includes:

a second generation circuit configured to generate a second CRC value that is a CRC value of the image data received from the display control circuit; and a second transmission circuit configured to transmit the second CRC value to the processing device, the processing device includes:

a second expected value generation circuit to which the image data is received from the display control circuit and that is configured to generate a second CRC expected value that is a CRC value of the image data;

a second reception circuit configured to receive the second CRC value transmitted by the second transmission circuit; and a second comparison circuit configured to compare the second CRC expected value generated by the second expected value generation circuit with the second CRC value received by the second reception circuit, and the control circuit executes control based on a comparison result between the second CRC expected value and the second CRC value, the comparison result being obtained by the second comparison circuit.

4. The display circuit device according to claim 1, wherein the drive circuit includes a second selection circuit configured to select one of the command data received from the processing device and the image data received from the display control circuit and output the selected data, the processing device includes a third selection circuit configured to select one of the command data before being input to the drive circuit and the image data received from the display control circuit and output the selected data, the first generation circuit generates, when the second selection circuit selects the command data, the first CRC value that is a CRC value of the command data output from the second selection circuit, and generates, when the second selection circuit selects the image data, a second CRC value that is a CRC value of the image data output from the second selection circuit, the first transmission circuit transmits the first CRC value or the second CRC value to the processing device, the first reception circuit receives the first CRC value or the second CRC value transmitted by the first transmission circuit, the first expected value generation circuit generates, when the third selection circuit selects the command data, the first CRC expected value that is a CRC value of the command data output from the third selection circuit, and generates, when the third selection circuit selects the image data, a second CRC expected value that is a CRC value of the image data output from the third selection circuit, the first comparison circuit compares the first CRC expected value generated by the first expected value generation circuit with the first CRC value received by the first reception circuit, and further compares the second CRC expected value generated by the first expected value generation circuit with the second CRC value received by the first reception circuit, and the control circuit executes control based on a comparison result between the first CRC expected value and the first CRC value obtained by the first comparison circuit and a comparison result between the second CRC expected value and the second CRC value obtained by the second comparison circuit.

5. A display circuit device comprising:

a processing device;

a display control circuit; and a drive circuit to which command data is received from the processing device and image data is received from the display control circuit, and that is configured to drive a display panel based on the image data and the command data, wherein the drive circuit includes:

a first generation circuit configured to generate a first CRC value that is a CRC value of the command data received from the processing device; and a first transmission circuit configured to transmit the first CRC value to the display control circuit, the display control circuit includes:

a first expected value generation circuit configured to generate a first CRC expected value that is a CRC value of the command data before being input to the drive circuit;

a first reception circuit configured to receive the first CRC value transmitted by the first transmission circuit; and a first comparison circuit configured to compare the first CRC expected value generated by the first expected value generation circuit with the first CRC value received by the first reception circuit, and the processing device includes the control circuit configured to execute control based on a comparison result between the first CRC expected value and the first CRC value, the comparison result being obtained by the first comparison circuit.

6. The display circuit device according to claim 5, wherein the drive circuit includes:

a command register configured to store the command data received from the processing device; and a first selection circuit configured to select one of first command data that is command data before being stored in the command register and second command data that is command data stored in the command register and output the selected command data, and the first generation circuit generates a CRC value of the first command data as the first CRC value when the first selection circuit selects the first command data, and generates a CRC value of the second command data as the first CRC value when the first selection circuit selects the second command data.

7. The display circuit device according to claim 5, wherein the drive circuit includes:

a second generation circuit configured to generate a second CRC value that is a CRC value of the image data received from the display control circuit; and a second transmission circuit configured to transmit the second CRC value to the display control circuit, the display control circuit includes:

a second expected value generation circuit configured to generate a second CRC expected value that is a CRC value of the image data to be transmitted to the drive circuit;

a second reception circuit configured to receive the second CRC value transmitted by the second transmission circuit; and a second comparison circuit configured to compare the second CRC expected value generated by the second expected value generation circuit with the second CRC value received by the second reception circuit, and the control circuit executes control based on a comparison result between the second CRC expected value and the second CRC value, the comparison result being obtained by the second comparison circuit.

8. The display circuit device according to claim 5, wherein the drive circuit includes a second selection circuit configured to select one of the command data received from the processing device and the image data received from the display control circuit and output the selected data, the display control circuit includes a third selection circuit configured to select one of the command data before being input to the drive circuit and the image data to be output to the drive circuit and output the selected data, the first generation circuit generates, when the second selection circuit selects the command data, the first CRC value that is a CRC value of the command data output from the second selection circuit, and generates, when the second selection circuit selects the image data, a second CRC value that is a CRC value of the image data output from the second selection circuit, the first transmission circuit transmits the first CRC value or the second CRC value to the display control circuit, the first reception circuit receives the first CRC value or the second CRC value transmitted by the first transmission circuit, the first expected value generation circuit generates, when the third selection circuit selects the command data, the first CRC expected value that is a CRC value of the command data output from the third selection circuit, and generates, when the third selection circuit selects the image data, a second CRC expected value that is a CRC value of the image data output from the third selection circuit, the first comparison circuit compares the first CRC expected value generated by the first expected value generation circuit with the first CRC value received by the first reception circuit, and further compares the second CRC expected value generated by the first expected value generation circuit with the second CRC value received by the first reception circuit, and the control circuit executes control based on a comparison result between the first CRC expected value and the first CRC value obtained by the first comparison circuit and a comparison result between the second CRC expected value and the second CRC value obtained by the second comparison circuit.

9. A display device comprising:

the display circuit device according to claim 1; and the display panel.

10. An electronic apparatus comprising:

the display device according to claim 9.

11. A display circuit device comprising:

a first receiver configured to receive command data, image data, and a control signal from a processor;

a first transmitter configured to transmit the command data and the image data to a display driver;

a CRC value generator configured to generate a first CRC value from the command data;

a second receiver configured to receive a second CRC value from the display driver, the second CRC value is generated from the command data in the display driver;

a comparator configured to compare the first CRC value and the second CRC value and generate comparison result; and a second transmitter configured to transmit the comparison result to the processor, wherein the command data is data for setting an operation of the display driver, the image data includes data that defines a gradation to be displayed in each pixel circuit of a display panel, and the control signal includes a synchronization signal.

12. The display circuit device according to claim 5, wherein the drive circuit receives a control signal from the display control circuit, and the command data is data for setting an operation of the drive circuit, the image data includes data that defines a gradation to be displayed in each pixel circuit of the display panel, and the control signal includes a synchronization signal.

* * * * *